US008993911B2

(12) United States Patent
Hirota

(10) Patent No.: US 8,993,911 B2
(45) Date of Patent: Mar. 31, 2015

(54) SWITCH LEVER DEVICE AND OPEN/CLOSE DETECTION DEVICE

(75) Inventor: Hideyuki Hirota, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 218 days.

(21) Appl. No.: 13/578,300

(22) PCT Filed: Jun. 25, 2010

(86) PCT No.: PCT/JP2010/004241
§ 371 (c)(1),
(2), (4) Date: Aug. 10, 2012

(87) PCT Pub. No.: WO2011/161733
PCT Pub. Date: Dec. 29, 2011

(65) Prior Publication Data
US 2012/0312671 A1 Dec. 13, 2012

(51) Int. Cl.

| | |
|---|---|
| ***H01H 3/04*** | (2006.01) |
| ***H01H 3/20*** | (2006.01) |
| ***H01H 21/18*** | (2006.01) |
| ***H01H 3/16*** | (2006.01) |
| ***H01H 21/06*** | (2006.01) |

(52) U.S. Cl.
CPC ..... *H01H 21/18* (2013.01); *H01H 3/161* (2013.01); *H01H 21/06* (2013.01)
USPC ..... 200/335

(58) Field of Classification Search
CPC ..... H01H 3/16; H01H 3/161; H01H 3/162
USPC ..... 200/335, 61.7, 61.81, 61.76, 61.62
See application file for complete search history.

(56) References Cited

U.S. PATENT DOCUMENTS

| | | | | |
|---|---|---|---|---|
| 3,149,212 | A * | 9/1964 | Smith | 200/61.7 |
| 4,764,648 | A * | 8/1988 | Resh | 200/50.1 |
| 5,682,772 | A * | 11/1997 | Hapke et al. | 68/12.26 |
| 5,690,206 | A * | 11/1997 | Carroll et al. | 192/136 |
| 6,242,706 | B1 * | 6/2001 | Miyata | 200/537 |
| 7,939,775 | B2 * | 5/2011 | Kim | 200/332 |
| 8,497,443 | B2 * | 7/2013 | Shimizu | 200/335 |

FOREIGN PATENT DOCUMENTS

| | | | |
|---|---|---|---|
| JP | 55-165550 | U | 11/1980 |
| JP | 57-16136 | U | 1/1982 |
| JP | 60-158626 | U | 10/1985 |
| JP | 61-131031 | U | 8/1986 |
| JP | 63-114231 | U | 7/1988 |
| JP | 2006-302397 | A | 11/2006 |

* cited by examiner

*Primary Examiner* — Edwin A. Leon
*Assistant Examiner* — Lheiren Mae A Caroc
(74) *Attorney, Agent, or Firm* — Birch, Stewart, Kolasch & Birch, LLP

(57) ABSTRACT

When a lever driving section 43 that rotates integrally with a display 2 about a shaft 5*a* is pushed out by a concave portion 51, a switch operating section 44 on the other end side is rotated about a rotational central section 41 to turn off a switch 30. When the lever driving section 43 is drawn into a convex portion 53, the switch operating section 44 is rotated about the rotational central section 41 to turn on the switch 30.

6 Claims, 8 Drawing Sheets

SWITCH LEVER DEVICE AND OPEN/CLOSE DETECTION DEVICE

TECHNICAL FIELD

The present invention relates to a switch lever device used for detecting the opening/closing of an opening/closing body such as a display and an opening/closing detecting device.

BACKGROUND ART

FIG. 11 and FIG. 12 are perspective views each showing an arrangement of a display unit 1; FIG. 11 is a closed position thereof, and FIG. 12 is an opened position thereof. A display 2 and a housing case (main body) 3 for housing the display are openably and closably connected to each other through a left and a right hinge section 4, 5. The display 2 is composed of a front panel 7 in which an opening 6 for a screen display is open-provided, and a back panel 8.

FIG. 13 is a perspective view showing an arrangement of a conventional opening/closing detecting device incorporated in the display unit 1, and shows an internal structure of the display 2 with a back panel 8 removed. Disposed inside the display 2 are a holder 101 made of metal; a board 102 fixed to the holder 101; a switch 103, mounted on the board 102, for detecting the opened/closed position of the display 2; a lever 104 for turning on/off the switch 103 in cooperation with the opening/closing movement of the display 2; a lever holder 105 for holding the lever 104; a screw 105*a* for fixing the lever holder 105 to the holder 101; and a spring 106 for urging the lever 104. Further, a concave-convex section 107 for pushing the lever 104 against the energization of the spring 106 is disposed around the shaft 4*a* of the hinge section 4 that connects the housing case 3 to the display 2.

Provided on one end side of the lever 104 held by the lever holder 105 is a lever driving section 108 that comes into contact with the concave-convex section 107 and rotates about the shaft 5*a* integrally with the display 2 to travel along concave and convex portions thereof. A switch operating section 109 for turning on/off the switch 103 is provided on the other end side thereof. The lever driving section 108 is normally pushed in a direction of the concave-convex section 107 by the urging force of the spring 106; when the display 2 is in a closed position as shown in FIG. 13, the lever driving section 108 is pushed out by a convex portion 110 of the concave-convex section 107. When the lever driving section 108 on the one end side is pushed out by the convex portion 110, the switch operating section 109 on the other end side is also slid to come to a position that presses the switch 103.

On the other hand, when the display 2 is opened, the lever driving section 108 is also moved integrally to be drawn into a concave portion 111 of the concave-convex section 107. When the lever driving section 108 on the one end side is drawn into the concave portion 111, the switch operating section 109 on the other end side is also slid to come to a position that releases the switch 103.

Further, in an opening/closing detecting mechanism of Patent Document 1, for example, an opening/closing body is fixed to an end portion of a supporting shaft serving as a swinging shaft, wherein the mechanism is provided with: a cam member of which the outside face in an extending direction of the supporting shaft provides a cam face; a return spring of the cam member; and a detection switch having a movable section (lever) that moves between an ON position where it is determined that the opening/closing body is in an opened position and an OFF position where it is determined that the opening/closing body is in a closed position, wherein the cam face of the cam member is configured to have a shape such that the movable section of the detecting switch is moved between the ON position and the OFF position, when the cam member is rotated by the opening/closing of the opening/closing body.

As mentioned above, the conventional opening/closing detecting device turns on/off the screen of the display such that the members following the opening/closing movement of the display turn on/off the switch.

PRIOR ART DOCUMENTS

Patent Documents

Patent Document 1: JP-A-2006-302397

SUMMARY OF THE INVENTION

However, since the opening/closing detecting device shown in FIG. 13 uses a large number of components including the holder 101, lever 104, lever holder 105, screw 105*a*, spring 106, and the like, there is a problem such that the device requires the number of man-hours for assembly. The opening/closing detecting mechanism disclosed in Patent Document 1 also uses a large number of components including the supporting shaft, cam member, spring, lever, and the like, which requires the number of man-hours for assembly.

Furthermore, the amount of slide (arrow Z1 shown in FIG. 13) of the lever 104 for pushing the switch 103 and the amount of difference in height between the convex portion 110 and the concave portion 111 (arrow Z2 shown in FIG. 13) are provided on a 1:1 scale, and when the difference in height between the convex portion 110 and the concave portion 111 cannot be set to be greater, there is a problem such that the operational sensitivity of the lever 104 for turning on/off the switch 103 is deteriorated.

The present invention is made to solve the aforementioned problems, and an object of the invention is to provide a switch lever device and an opening/closing detecting device that lessen the number of components to reduce the number of man-hours for assembly, and further enhance the operational sensitivity of a lever for turning on/off a switch.

A switch lever device of the present invention includes: a lever provided with a lever driving section on one end side thereof, a switch operating section for turning on/off a switch on the other end side thereof, and a rotational central section in a position halfway therebetween, wherein when the lever driving section on the one end side is pushed, the switch operating section on the other end side is rotated about the rotational central section to turn on/off the switch; and a holder for pivotally supporting the rotational central section of the lever.

An opening/closing detecting device of the invention is an opening/closing detecting device for detecting the opened/closed position of an opening/closing body that is openably and closably connected to a main body through a hinge section, wherein the main body includes a concave-convex section provided with a concave and a convex portion about a shaft of the hinge section, and wherein the opening/closing body includes: a switch for detecting the opened/closed position according to ON/OFF thereof; a lever provided with a lever driving section on one end side thereof that moves along the concave and convex portions with coming into contact with the concave-convex section and rotating integrally with the opening/closing body, a switch operating section for turning on/off the switch on the other end side thereof, and a rotational central section in a position halfway therebetween, wherein when the lever driving section on the one end side moves along the concave and convex portions of the concave-convex section, the switch operating section on the other end side is rotated about the rotational central section to turn on/off the switch; and a holder for pivotally supporting the rotational central section of the lever.

According to the present invention, since it is arranged that the lever is pivotally supported by the holder, and turns on/off the switch when rotated in cooperation with the opening/closing movement of the opening/closing body, the number of components thereof can be lessened to reduce the number of man-hours for assembly. Further, when the length from the rotational central section to the switch operating section is longer than the length from the rotational central section to the lever driving section, the amount of travel of the switch operating section can be increased, and thus the switch operation sensitivity of the lever can be enhanced.

BEST MODE FOR CARRYING OUT THE INVENTION

In the following, in order to explain the present invention in more detail, embodiments of the invention will be described with reference to the accompanying drawings.

First Embodiment

Figure 11:
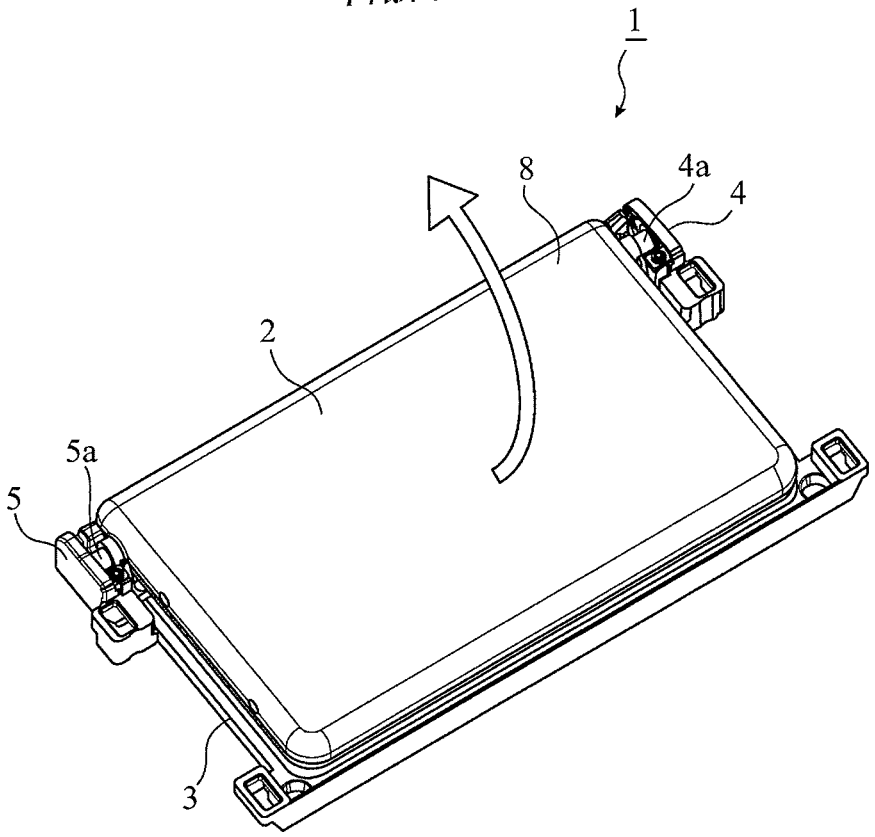
FIG.11 Prior Art
FIG. 11 is a perspective view of an arrangement of a display unit, and a display is in a closed position.
Figure 12:
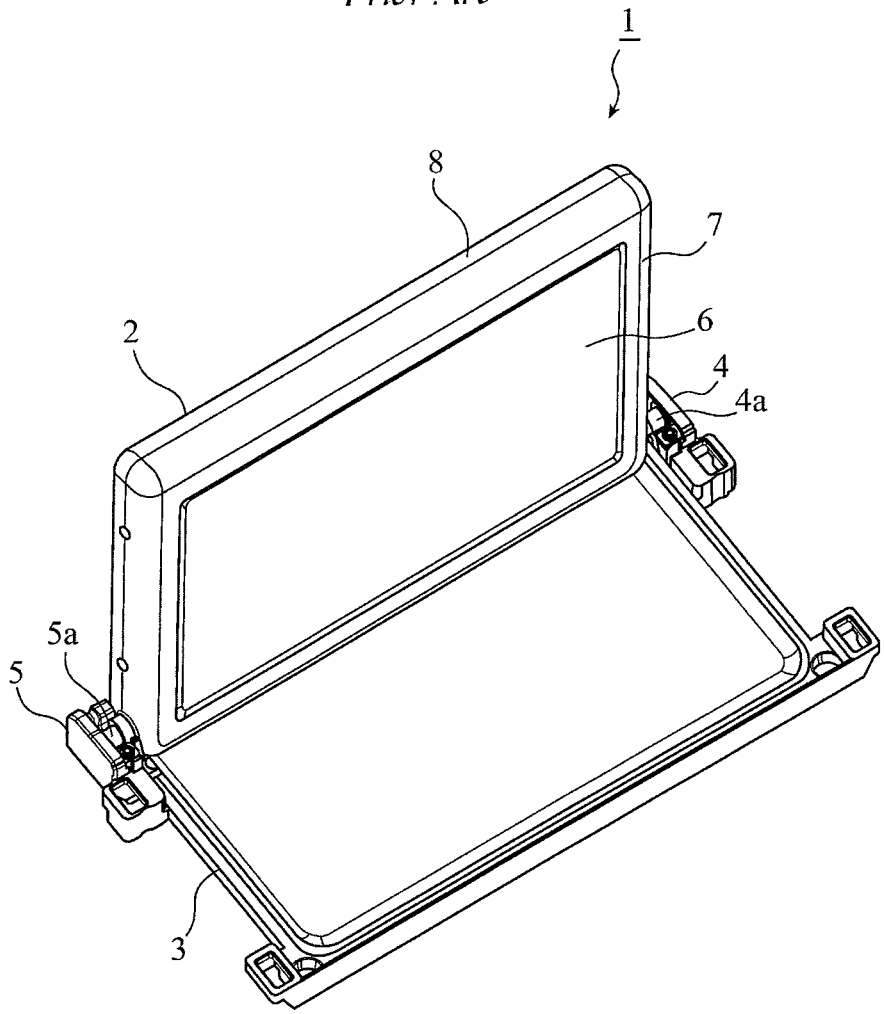
FIG.12 Prior Art
FIG. 12 is a perspective view showing the arrangement of the display unit, and the display is in an opened position.
Figure 13:
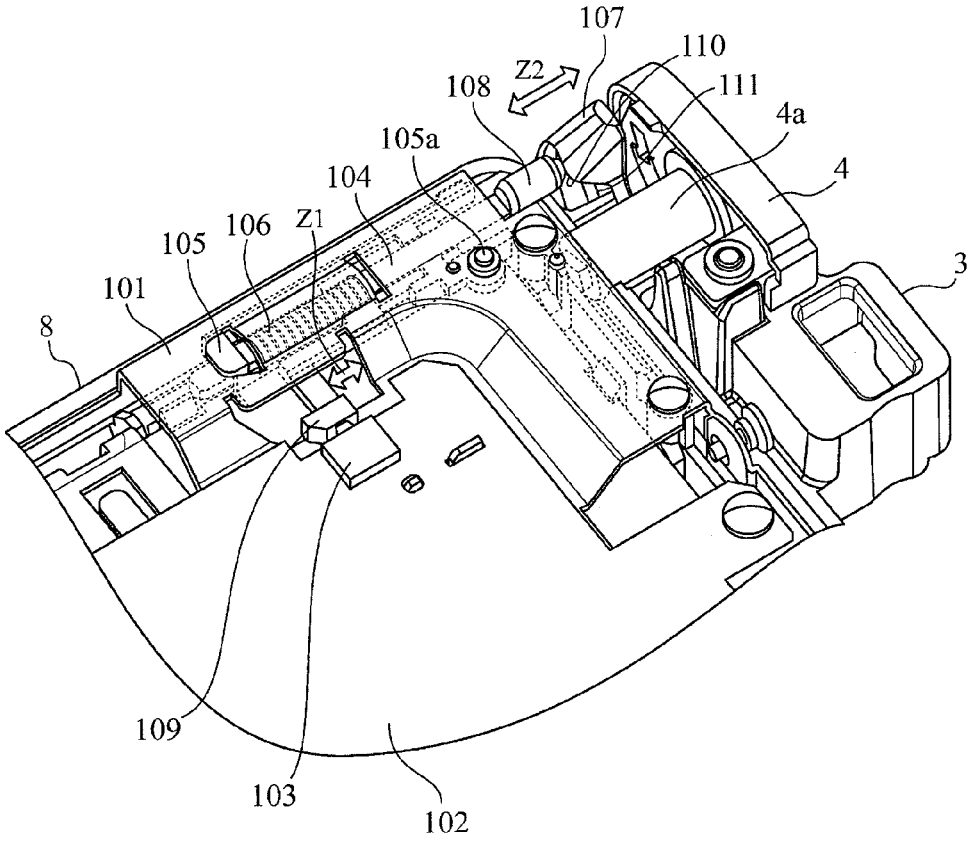
FIG.13 Prior Art
FIG. 13 is a perspective view showing an arrangement of a conventional opening/closing detecting device.

Also in a first embodiment, an opening/closing detecting device and a switch lever device that each detect the opened/closed position of a display (opening/closing body) 2 with respect to a housing case (main body) 3 are described by a display unit 1 as shown in FIG. 11 and FIG. 12 previously discussed by way of example.

Figure 1:
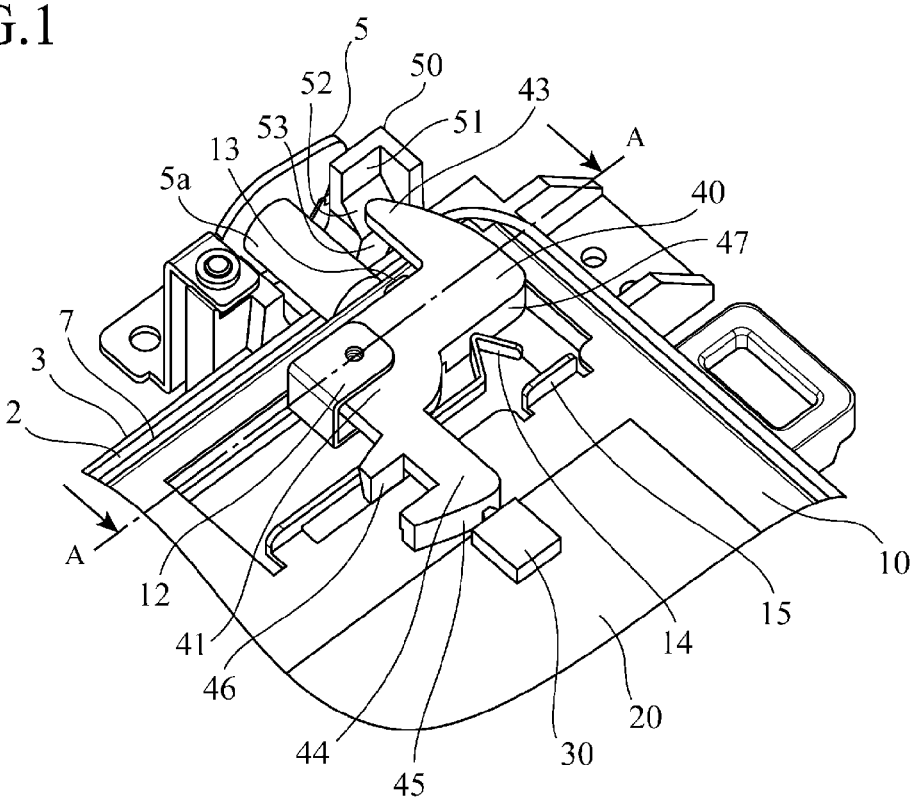
FIG. 1 is a perspective view showing an arrangement of an opening/closing detecting device of a first embodiment in the present invention, and a display is held in a closed position.
Figure 2:
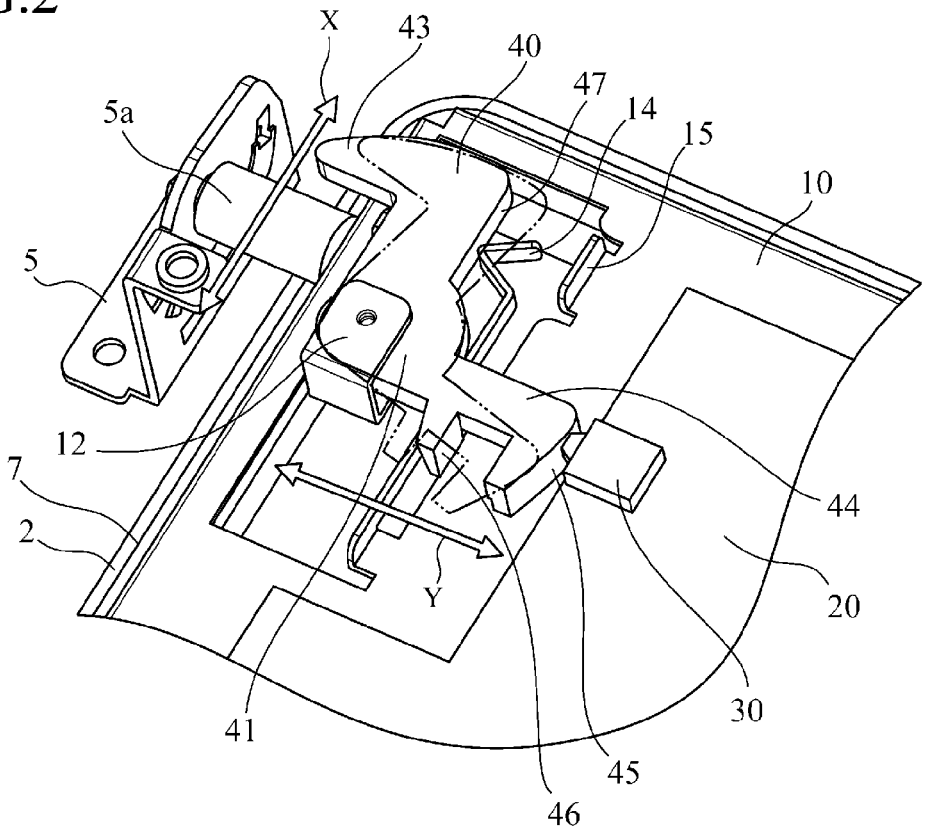
FIG. 2 is a perspective view showing an arrangement of a switch lever device in the opening/closing detecting device of the first embodiment.
Figure 3:
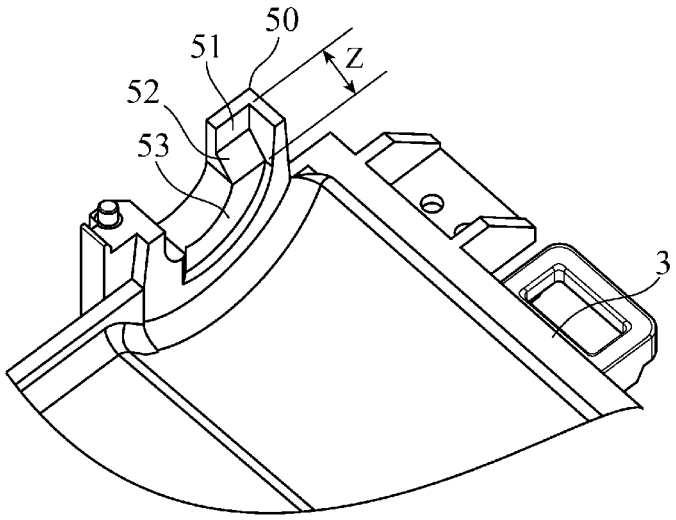
FIG. 3 is a perspective view showing an arrangement of a housing case in the opening/closing detecting device of the first embodiment.

FIG. 1 is a perspective view showing an arrangement of an opening/closing detecting device in accordance with the first embodiment, and shows an internal structure of the display 2 with a back panel 8 removed. FIG. 2 shows an arrangement of a switch lever device in the opening/closing detecting device, and FIG. 3 shows an arrangement of the housing case 3. As shown in FIG. 1 and FIG. 2, disposed inside the display 2 are a holder 10 made of metal; a board 20 fixed to the holder 10; a switch 30 that is mounted on the board 20, and detects the opened/closed position of the display 2; and a lever 40 cooperating with the opening/closing movement of the display 2 to turn on/off the switch 30. Further, as shown in FIG. 3, a concave-convex section 50 for pushing the lever 40 is disposed around a shaft 5*a* of a hinge section 5 which connects the housing case 3 and the display 2 to each other. The switch lever device is composed of the holder 10 and the lever 40, and the opening/closing detecting device is composed of the switch lever device, the switch 30, and the concave-convex section 50.

The lever 40 includes: a rotational central section 41; a lever driving section 43 extending from the rotational central section 41 pivotally supported by the holder 10; and a switch operating section 44 extending from the rotational central section 41 in a direction that is different from that of the lever driving section 43. When the display 2 is in a closed position, there is no force pushing the lever driving section 43; thus, as shown by a solid line in FIG. 2, the switch operating section 44 is in a position where the switch operating section pushes the switch 30 with a press face 45 thereof. Hereinafter, this position is referred to as an ON position. On the other hand, when the display 2 is in the opened position, as shown by a dash-double dot line in FIG. 2, the lever driving section 43 is pushed, and the switch operating section 44 is rotated about the rotational central section 41 to come to a position out of contact with the switch 30. Hereinafter, this position is referred to as an OFF position.

In a condition where the lever 40 is in the ON position to be pushed by the switch operating section 44, the switch 30 detects that the display 2 is in the closed position; contrarily, in a condition where the lever 40 is in the OFF position to be released from the switch operating section 44, the switch detects that the display 2 is in the opened position. When the detection results of the switch 30 are associated with the screen display operation of the display 2, the screen display is turned off when the display 2 is in the closed position, and turned on when the display is in the opened position.

As shown in FIG. 1 and FIG. 3, the concave-convex section 50 is composed of a concave and a convex portion formed integrally with the housing case 3 around the shaft 5*a*. When the display 2 is rotated about the shaft 5*a*, the lever driving section 43 coming into contact with the concave-convex section 50 moves along a concave portion 51, a tapered face 52, and a convex portion 53. Base on the height of the concave portion 51 as a reference, the lever driving section 43 is pushed by the amount (difference in height Z shown in FIG. 3) corresponding to the height of the tapered face 52 and the convex portion 53 higher than the height of the concave portion.

When a length from the rotational central section 41 to the switch operating section 44 as shown by arrow Y of FIG. 2 is made longer than a length from the rotational central section 41 to the lever driving section 43 as shown by arrow X thereof, the amount of travel of the tip of arrow Y (namely, the press face 45) is larger than that of the tip of arrow X; thus, the operational sensitivity of the lever 40 for turning on/off the switch 30 is increased. Thus, even when the difference in height Z of the concave-convex section 50 cannot be set to have a large value, the switch operating section 44 is elongated to change a ratio between the amount of difference in height Z and the amount of travel of the switch operating section 44, thereby enhancing the switch operational sensitivity of the lever 40. Further, in the illustrated example, an angle between the lever driving section 43 and the switch operating section 44 is formed to be substantially 90 degrees, not limited to this, and may be formed at any angle.

Figure 4:
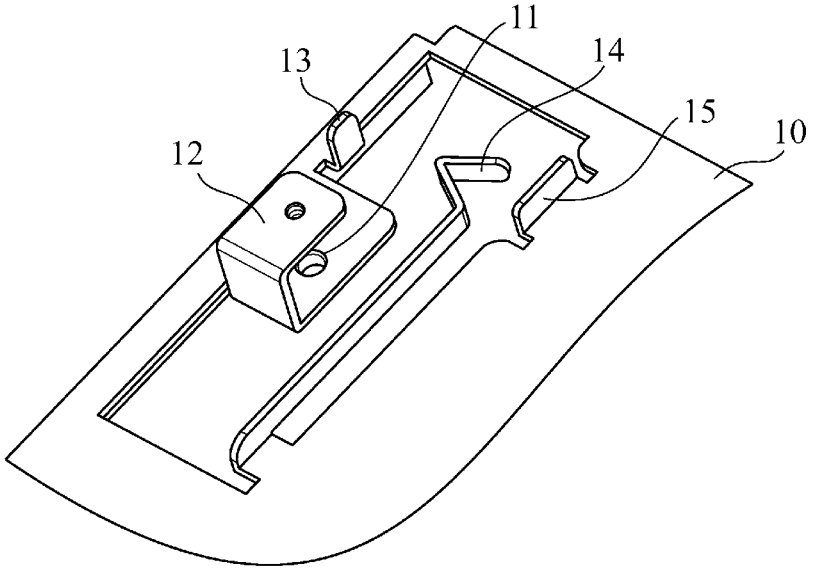
FIG. 4 is a perspective view showing an arrangement of a holder in the opening/closing detecting device of the first embodiment.
Figure 5:
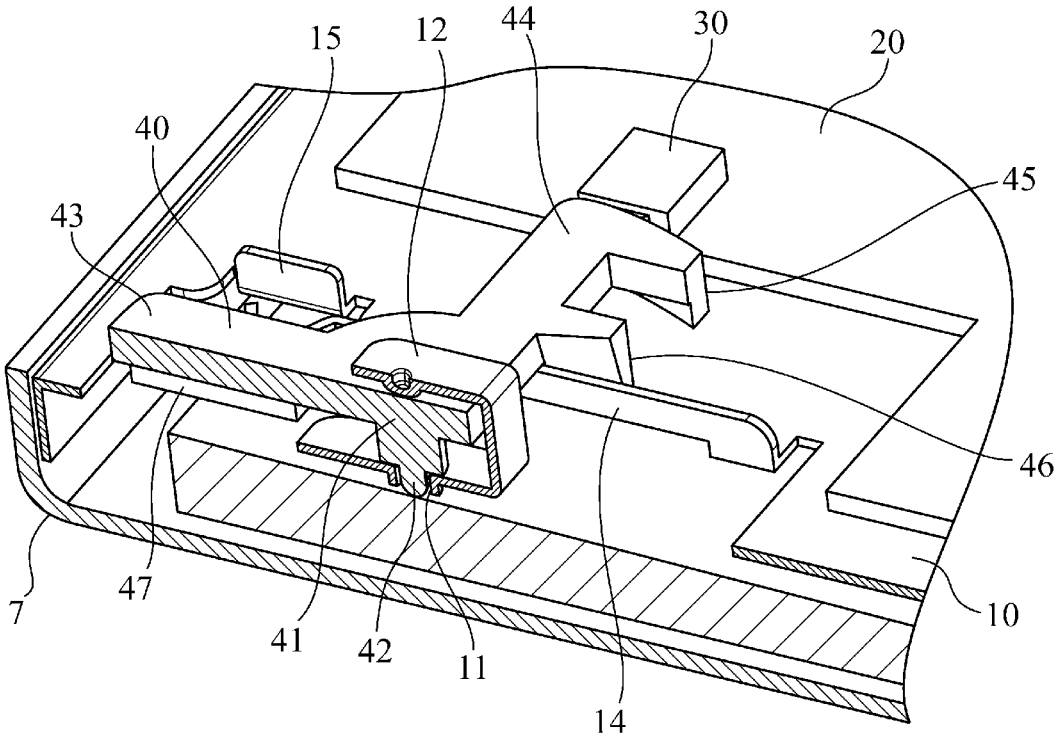
FIG. 5 is a sectional view of the holder and a lever taken along a line A-A shown in FIG. 1.

FIG. 4 shows an arrangement of the holder 10. Further, FIG. 5 shows a sectional view of the holder 10 and lever 40 taken along a line A-A in FIG. 1. A rotation shaft section 42 is protrusively provided on one side of the rotational central section 41 of the lever 40; the tip of the rotation shaft section 42 is shaped in a sphere to minimize a contact area thereof, thus reducing the friction during the slide. In the other holder 10, a rotation shaft hole 11 into which the rotation shaft section 42 is inserted is formed by a burring process (a process making a hole and raising the periphery thereof) or the like. Moreover, a lever holding section 12 for pressing the rotation shaft section 42 of the lever 40 from the opposite side by elastic force is formed by lancing (upward-lancing) of the holder 10, and a projection is provided on the lever holding section 12, the tip of the projection being formed in a sphere to minimize a contact area thereof. When the rotational central section 41 of the lever 40 is pivotally supported by the rotation shaft hole 11 and lever holding section 12, the lever 40 comes to be rotatable about the rotation shaft section 42.

Further, a lever urging section 14 is formed by lancing of the holder 10, and urges the lever driving section 43 toward a direction of the ON position before a pushed action, when the lever driving section 43 is pushed and moved to be in the OFF position. Furthermore, a lever stopper 13 that comes into contact with the lever driving section 43 urged by the lever urging section 14 is formed by lancing in the direction of the ON position of the lever driving section 43. In this way, it is arranged as a structure such that the lever driving section 43 is sandwiched between the lever stopper 13 and the lever urging section 14. It is noted that a portion in which the lever driving section 43 comes into contact with the lever urging section 14 is referred to as a contact portion 47.

Moreover, an urging section stopper 15 is formed by lancing of the holder 10 opposite the side where the lever urging section 14 is opposed to the lever stopper 13, and restrains the lever urging section 14 from being excessively resiliently deformed because of the pushing of the lever driving section 43. Therefore, the lever urging section 14 is prevented from being deformed beyond the position of the urging section stopper 15 because of the pushing of the lever driving section 43.

Figure 6:
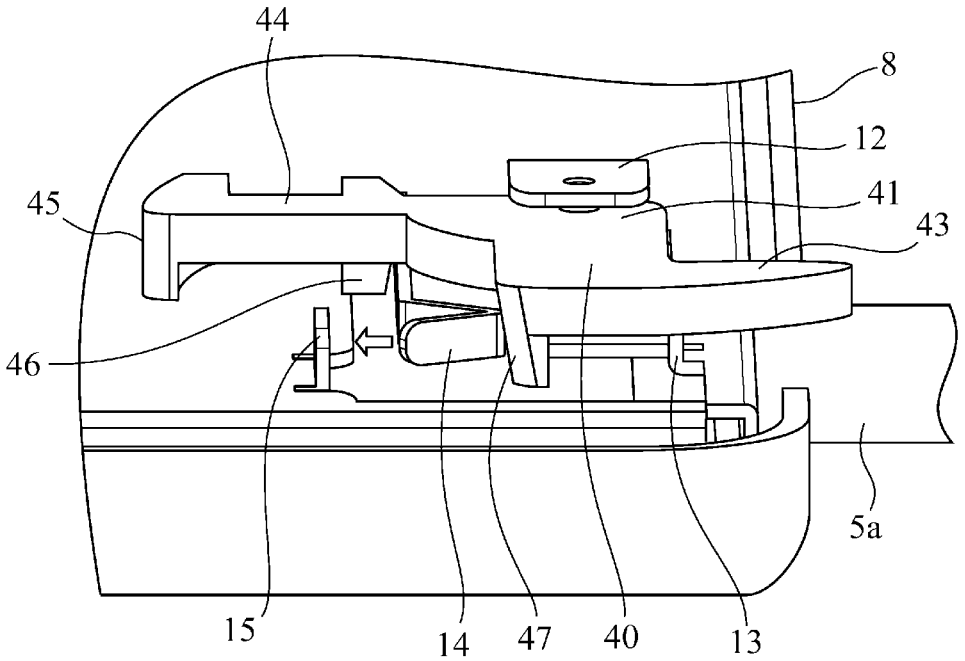
FIG. 6 is an enlarged perspective view of the opening/closing detecting device of the first embodiment.

FIG. 6 is an enlarged perspective view of the opening/closing detecting device. A rib 46 for correcting the deformation of the lever urging section 14 is protrusively provided in the lever 40. When the lever 40 is attached to the holder 10, the rotational central section 41 is slid to be fit therein with the lever holding section 12 flexed. At this time, the lever 40 is slid with the lever urging section 14 being sandwiched between the rib 46 and the contact portion 47 to thus correct the shape of the lever urging section 14 deformed in an arrow direction of FIG. 6.

Next, an operation of the opening/closing detecting device will be described. FIG. 1 shows the closed position where the display 2 is housed in the housing case 3, and FIG. 7 shows an opened position where the display 2 is being opened with rotating about the shaft 5*a*.

In the closed position shown in FIG. 1, the lever driving section 43 of the lever 40 is urged by the lever urging section 14 of the holder 10 to come into contact with the concave portion 51 of the concave-convex section 50. At this time, since the lever 40 is in the ON position, the press face 45 of the switch operating section 44 keeps pressing the switch 30.

Figure 7:
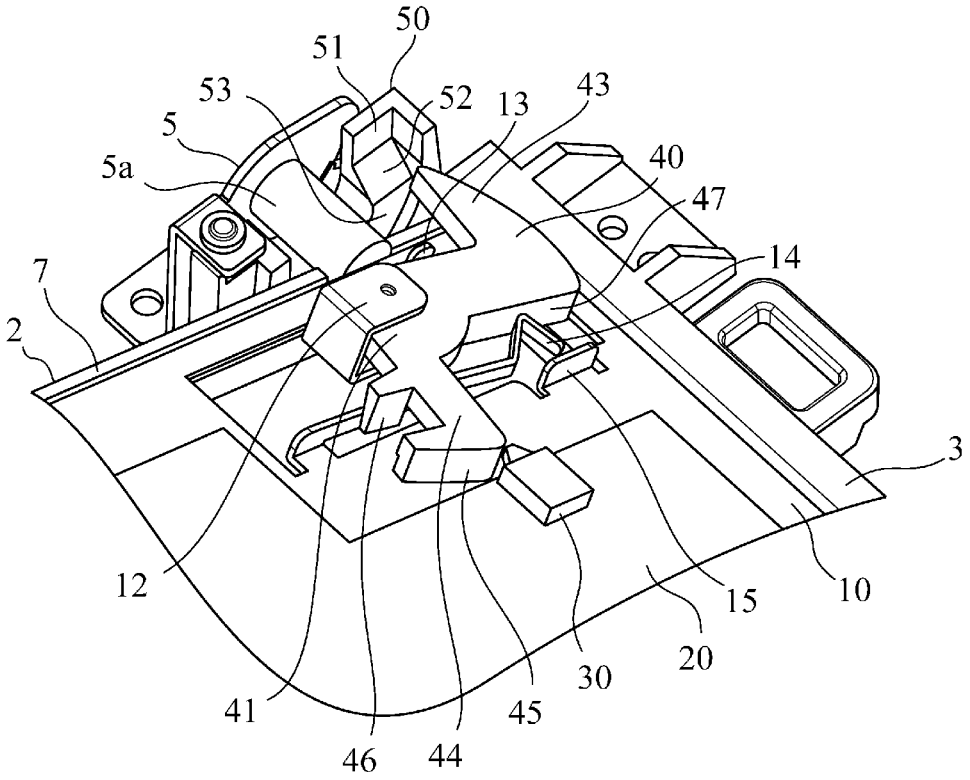
FIG. 7 is a perspective view showing the arrangement of the opening/closing detecting device of the first embodiment, and the display is in an opened position.

When the display 2 is rotated about the shaft 5*a* to be opened, the lever driving section 43 passes from the concave portion 51 by way of the tapered face 52 to move as riding on the convex portion 53 as shown in FIG. 7. In this way, when the lever driving section 43 on one side is pushed out by the convex portion 53, the switch operating section 44 on the other side is rotated about the rotational central section 41 toward the OFF position to release the switch 30.

When the display 2 is rotated about the shaft 5*a* to be closed, the lever driving section 43 having been pressed to the side of the concave-convex section 50 by the returning force of the lever urging section 14 goes down the tapered face 52 to move to the concave portion 51. In this way, when the lever driving section 43 on the one side is drawn into the concave portion 51, the switch operating section 44 on the other side is rotated about the rotational central section 41 toward the ON position to press the switch 30.

As described above, according to the first embodiment, the switch lever device is arranged to include: the lever 40 provided with the lever driving section 43 on one end side thereof, the switch operating section 44 for turning on/off the switch 30 on the other end side thereof, and the rotational central section 41 in a position halfway therebetween, wherein when the lever driving section 43 on the one end side is pushed, the switch operating section 44 on the other end side is rotated about the rotational central section 41 to turn on/off the switch 30; and the holder 10 for pivotally supporting the rotational central section 41 of the lever 40. Therefore, it is configured that the switch lever device includes: only the lever 40 for turning on/off the switch 30 by rotating in cooperation with the opening/closing movement of the display 2; and the holder 10 for fixation, thus lessening the number of components and reducing the number of man-hours for assembly. Further, the length from the rotational central section 41 to the switch operating section 44 can be set without restraint to the length from the rotational central section 41 to the lever driving section 43; thus, when the length of the switch operating section 44 is made longer than that of the lever driving section 43 to thereby make the amount of travel of the tip of the switch operating section 44 larger than that of the tip of the lever driving section 43, the operational sensitivity of the lever 40 for turning on/off the switch 30 can be enhanced.

Further, according to the first embodiment, it is contemplated that the opening/closing detecting device for detecting the opened/closed position of the display 2 openably and closably connected to the housing case 3 through the hinge section 5 is constructed by using the above-discussed switch lever device, wherein the housing case 3 includes the concave-convex section 50 provided with the concave and convex portions about the shaft 5*a* of the hinge section 5, and wherein the display 2 includes the switch 30 for detecting the opened/closed position according to ON/OFF of the switch; the lever provided with the lever driving section 43 on one end side thereof moving along the concave and convex portions with coming into contact with the concave-convex section 50 and rotating integrally with the display 2, the switch operating section 44 for turning on/off the switch 30 on the other end side thereof, and the rotational central section 41 in a position halfway therebetween, wherein when the lever driving section 43 on the one end side moves along the concave and convex portions of the concave-convex section 50, the switch operating section 44 on the other end side is rotated about the rotational central section 41 to turn on/off the switch 30; and the holder 10 for pivotally supporting the rotational central section 41 of the lever 40. For this reason, similarly to the switch lever device, the opening/closing detecting device can lessen the number of components and reduce the number of man-hours for assembly, and also can improve the operational sensitivity of the lever 40.

Further, according to the first embodiment, it is arranged that the switch lever device and the opening/closing detecting device each include: the lever urging section 14 that is formed by lancing of the holder 10 in a direction such that the lever driving section 43 is pushed and moved, and that urges the lever driving section 43 toward a direction before a pushed action; and the lever stopper 13 that is formed by lancing of the holder 10 in an position opposite the lever urging section 14 of the lever driving section 43, and that comes into contact with the lever driving section 43. For this reason, it is configured that the members for returning the lever 40 are formed of the holder 10, thereby lessening the number of components.

Moreover, according to the first embodiment, in the switch lever device and the opening/closing detecting device, it is arranged that the lever 40 has the rib 46 that corrects the deformation of the lever urging section by sandwiching the lever urging section 14 between the rib and the lever 40; thus, at the time of assembling the lever 40 to the holder 10, the rib 46 can self-correct the deformation of the lever urging section 14.

Further, according to the first embodiment, it is arranged that the switch lever device and the opening/closing detecting device each include the urging section stopper 15 formed by lancing of the holder 10 in a position that comes into contact with the lever urging section 14 resiliently deformed because of the pushing action of the lever driving section 43. For this reason, the lever urging section 14 can be restrained from being deformed more than a predetermined level due to the pushing action of the lever driving section 43. Moreover, the urging section stopper 15 is formed of the holder 10 to lessen the number of components.

Furthermore, according to the first embodiment, it is arranged that in the switch lever device and the opening/closing detecting device, the lever 40 have the rotation shaft section 42 protrusively provided on one side of the rotational central section 41, and the holder 10 have the rotation shaft hole 11 into which the rotation shaft section 42 is inserted, and the lever holding section 12, formed by lancing of the holder 10, for pressing the lever 40 from the side opposite the rotation shaft section 42. For this reason, the members for pivotally supporting the lever 40 are formed of the holder 10 to thus lessen the number of components.

Second Embodiment

Figure 8:
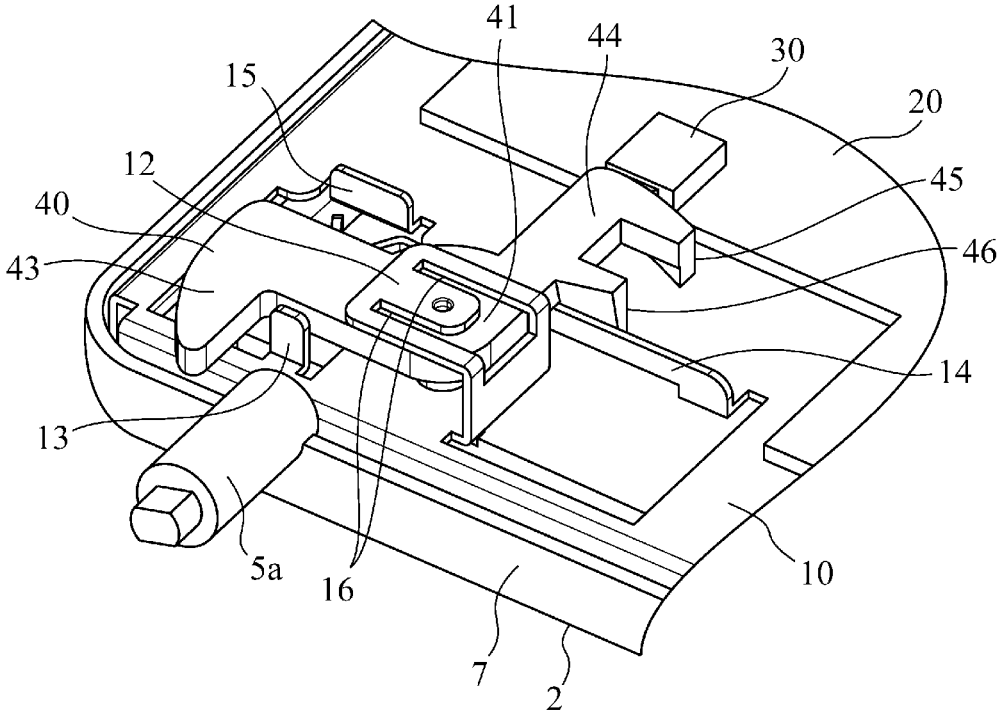
FIG. 8 is a perspective view showing an arrangement of an opening/closing detecting device in accordance with a second embodiment of the present invention.

FIG. 8 is a perspective view showing an arrangement of an opening/closing detecting device according to a second embodiment in the invention, and the same or equivalent parts as/to those in FIG. 1 to FIG. 7 are denoted by the same reference numerals, and descriptions thereof will be omitted. In the second embodiment, a slit 16 is provided in a lever holding section 12 of a holder 10. Therefore, the resilient force for pressing a lever 40 by the lever holding section 12 can be increased.

Third Embodiment

Figure 9:
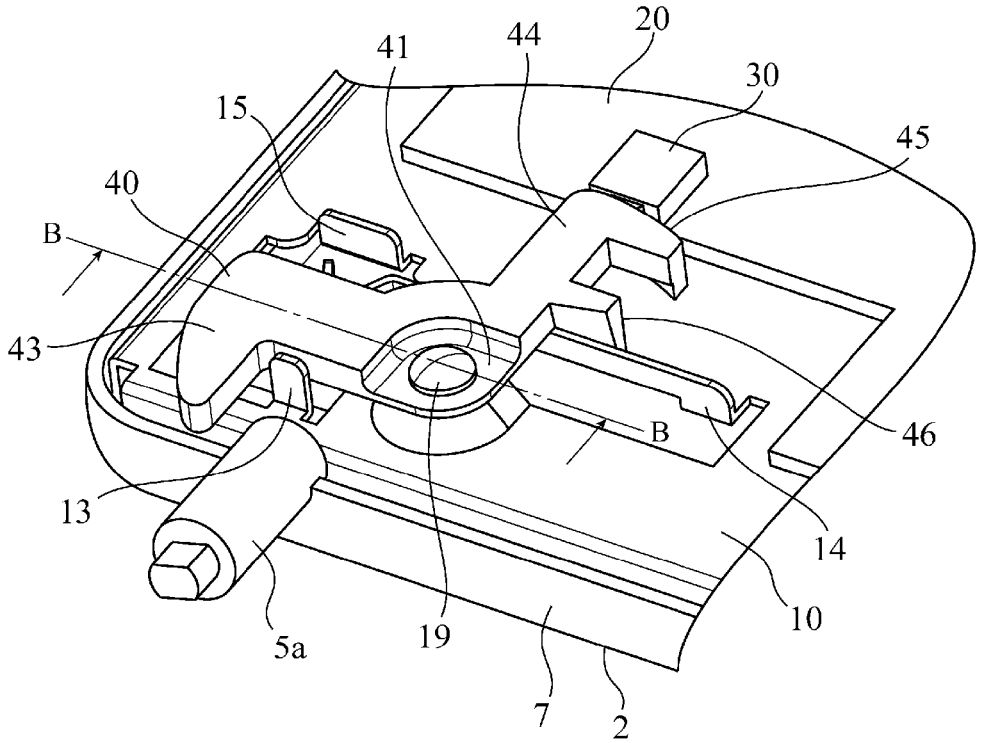
FIG. 9 is a perspective view showing an arrangement of an opening/closing detecting device in accordance with a third embodiment of the present invention.
Figure 10:
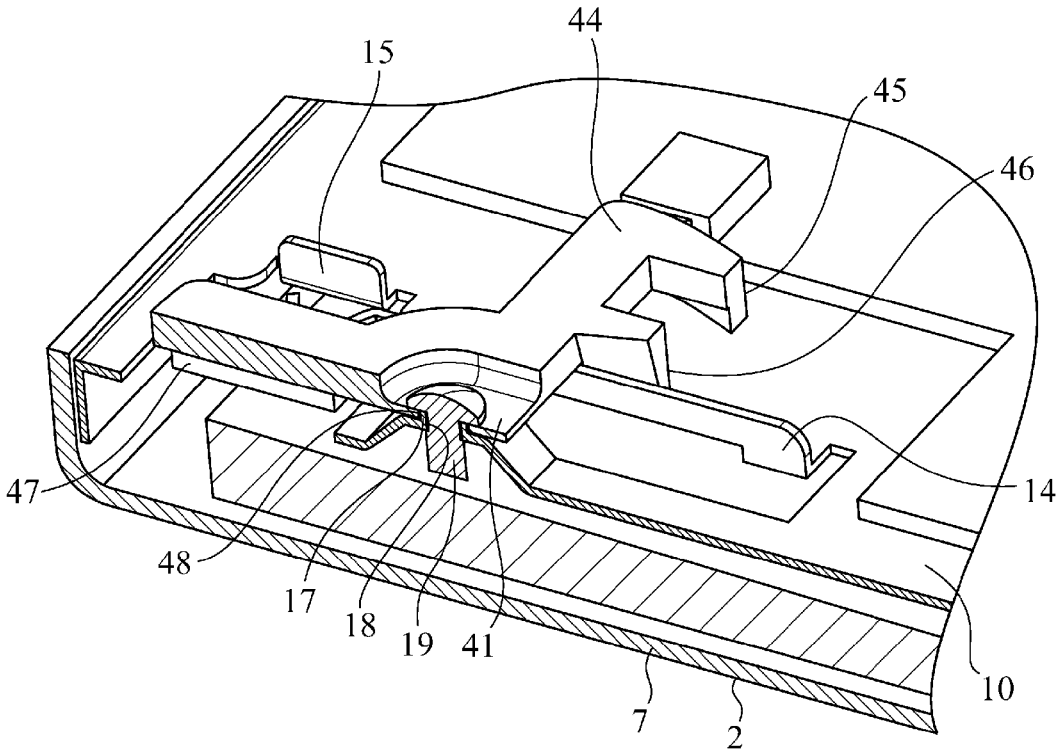
FIG. 10 is a sectional view of a holder and a lever taken along a line B-B shown in FIG. 9.

FIG. 9 is a perspective view showing an arrangement of an opening/closing detecting device according to a third embodiment in the invention, and the same or equivalent parts as/to those in FIG. 1 to FIG. 7 are denoted by the same reference numerals, and descriptions thereof will be omitted. Further, FIG. 10 shows a sectional view of a holder 10 and a lever 40 taken along a line B-B in FIG. 9. In the third embodiment, a rotation shaft hole 48 is pierced in a rotational central section 41 of the lever 40, and also a hole having a rising wall 17 is formed in the other holder 10 by a burring process, and the hole is provided as a screw hole 18. The rising wall 17 is fitted and inserted in the inner periphery of the rotation shaft hole 48, and a screw 19 is fastened in the screw hole 18. Therefore, the lever 40 and the holder 10 is rotatably mounted on a pivot, and the rotation shaft hole 48 turns around the outer periphery of the rising wall 17. As discussed above, even the switch lever device and the opening/closing detecting device that employ the screw hole 18 formed by the burring process as a rotation-center/screw-tap of the lever 40 have to use one screw 19 for pivotally supporting the lever 40; however, the number of components thereof can be lessened to reduce the number of man-hours for assembly as compared with the conventional arrangement.

Hereupon, the first to third embodiments of the present invention are described in detail with reference to the drawings; however, the specific arrangements of the device are not limited to those in the aforementioned embodiments, and it goes without saying that changes and modifications may be made without departing from the spirit and scope of the present invention. For example, in the first to third embodiments discussed above, it is arranged such that when the display 2 is in the opened position, the lever 40 turn off the switch 30, while when the display is in the closed position, the lever turn on the switch; however, the arrangement is not limited to this; when the concave and convex portions of the concave-convex section 50 are reversed, or the disposed position of the switch 30 is changed, it may be arranged such that when the display is in the opened position, the switch be turned on, while when the display is in closed position, the switch be turned off.

INDUSTRIAL APPLICABILITY

As described above, according to the switch lever device and the opening/closing detecting device of the present invention, it is arranged that the number of components thereof are lessened to reduce the number of man-hours for assembly and that also the switch operational sensitivity of the lever is enhanced, and it is thereby suitable for use in a switch lever device and an opening/closing detecting device employed for a display unit or the like.

The invention claimed is:

1. A switch lever device comprising:

a lever provided with a lever driving section on one end side thereof, a switch operating section for turning on/off a switch on the other end side thereof, and a rotational central section being in a position between the lever driving section and the switch operating section, wherein when the lever driving section is pushed, the switch operating section is rotated about the rotational central section to turn on/off the switch;

a holder for pivotally supporting the rotational central section of the lever;

a lever urging section that is formed by lancing of the holder, and that urges the lever, in which the lever driving section has been pushed, toward a direction of pushing back; and a lever stopper that is formed by lancing of the holder in a position of the lever driving section opposite the lever urging section, and that is touched to the lever urged by the lever urging section, wherein the lever is formed such that a length from the rotational central section to the switch operating section is longer than a length from the rotational central section to the lever driving section.

2. The switch lever device according to claim 1, wherein the lever has a rib for correcting deformation thereof by sandwiching the lever urging section between the lever and the rib.

3. The switch lever device according to claim 1, further comprising:

an urging section stopper formed by lancing of the holder in a position to come into contact with the lever urging section which is pushed by the lever driving section to be resiliently deformed.

4. A switch lever device comprising, a lever provided with a lever driving section on one end side thereof, a switch operating section for turing on/off a switch on the other end side thereof, and a rotational central section being in a position between the lever driving section and the switch operating section, wherein when the lever driving section is pushed, the switch operating section is rotated about the rotational central section to turn on/off the switch; and a holder for pivotally supporting the rotational central section of the lever, wherein the lever is formed such that a length from the rotational central section to the switch operating section is longer than a length from the rotational central section to the lever driving section, wherein the lever has a rotation shaft section protrusively provided on one side of the rotational central section, and wherein the holder has a rotation shaft hole into which the rotation shaft section is inserted, and a lever holding section for pressing the lever from the side opposite the rotation shaft section, the lever holding section being formed by lancing of the holder.

5. The switch lever device according to claim 4, wherein the lever holding section is provided with a slit.

6. A switch lever device comprising:

a lever provided with a lever driving section on one end side thereof, a switch operating section for turning on/off a switch on the other end side thereof, and a rotational central section being in a position between the lever driving section and the switch operating section, wherein when the lever driving section is pushed, the switch operating section is rotated about the rotational central section to turn on/ off the switch; and a holder for pivotally supporting the rotational central section of the lever, wherein the lever is formed such that a length from the rotational central section to the switch operating section is longer than a length from the rotational central section to the lever driving section, wherein the lever has a rotation shaft hole pierced in the rotational central section, and wherein the holder has a screw hole in which a rising wall fitted and inserted in the rotation shaft hole is formed by a burring process, and a screw fastened in the screw hole such that the lever and the holder is pivotally fit to be rotatable.

* * * * *